US007219701B2

(12) United States Patent
Ward

(10) Patent No.: US 7,219,701 B2
(45) **Date of Patent: *May 22, 2007**

(54) PAPERMAKER'S FORMING FABRIC WITH MACHINE DIRECTION STITCHING YARNS THAT FORM MACHINE SIDE KNUCKLES

(75) Inventor: Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/235,760

(22) Filed: Sep. 27, 2005

(65) Prior Publication Data

US 2007/0068591 A1 Mar. 29, 2007

(51) Int. Cl.
*D21F 7/08* (2006.01)
*D03D 11/00* (2006.01)
*D03D 25/00* (2006.01)

(52) U.S. Cl. ..... 139/383 A; 139/408; 139/413; 162/358.2

(58) Field of Classification Search ..... 139/383 A, 139/383 AA, 408, 413; 162/358.2, 900, 162/902, 903
See application file for complete search history.

(56) References Cited

U.S. PATENT DOCUMENTS

| | | | | |
|---|---|---|---|---|
| 2,172,430 A | | 9/1939 | Barrell | |
| 2,327,756 A | * | 8/1943 | Adamson | 219/545 |
| 2,554,034 A | | 5/1951 | Koester et al. | |
| 2,831,235 A | * | 4/1958 | Schuyler | 28/155 |
| 3,094,149 A | | 6/1963 | Keily | |
| 3,325,909 A | | 6/1967 | Clark | |
| 3,711,627 A | * | 1/1973 | Maringulov | 174/255 |
| 4,093,512 A | | 6/1978 | Fleischer | |
| 4,182,381 A | | 1/1980 | Gisbourne | |
| 4,244,543 A | | 1/1981 | Ericson | |
| 4,289,173 A | | 9/1981 | Miller | |
| 4,290,209 A | | 9/1981 | Buchanan et al. | |
| 4,414,263 A | | 11/1983 | Miller et al. | |

(Continued)

FOREIGN PATENT DOCUMENTS

| | | |
|---|---|---|
| DE | 454 092 | 12/1927 |

(Continued)

OTHER PUBLICATIONS

International Search Report for PCT/US2004/008311.

(Continued)

*Primary Examiner*—Robert H Muromoto
(74) *Attorney, Agent, or Firm*—Myers Bigel Sibley & Sajovec

(57) ABSTRACT

A papermaking fabric includes a series of repeat units, each of the repeat units including: a set of top machine direction (MD) yarns; a set of top cross machine direction (CMD) yarns interwoven with the set of top MD yarns; a first set of bottom CMD yarns, the first set of bottom CMD yarns arranged in pairs; a second set of bottom CMD yarns, the second set of bottom CMD yarns arranged as single yarns; a set of bottom CMD yarns interwoven with the first and second set of bottom MD yarns; and a set of pairs of MD stitching yarns interwoven with the top and bottom CMD yarns, each pair of MD stitching yarns sandwiching a respective immediately adjacent bottom MD yarn of the second set. Each of the yarns of a pair of the first set of bottom MD yarns interweaves with the bottom CMD yarns in the same pattern.

21 Claims, 10 Drawing Sheets

U.S. PATENT DOCUMENTS 4,438,788 A 3/1984 Harwood
4,452,284 A 6/1984 Eckstein et al.
4,453,573 A 6/1984 Thompson
4,501,303 A 2/1985 Osterberg
4,515,853 A 5/1985 Borel
4,529,013 A 7/1985 Miller
4,564,052 A 1/1986 Borel
4,564,551 A 1/1986 Best
4,577,256 A * 3/1986 Breidegam ..... 361/220
4,592,395 A 6/1986 Borel
4,592,396 A 6/1986 Borel et al.
4,605,585 A 8/1986 Johansson
4,611,639 A 9/1986 Bugge
4,621,663 A 11/1986 Malmendier
4,633,596 A 1/1987 Josef
4,636,426 A 1/1987 Fleischer
4,642,261 A 2/1987 Fearnhead
4,654,748 A * 3/1987 Rees ..... 361/220
4,676,278 A 6/1987 Dutt
4,705,601 A 11/1987 Chiu
4,709,732 A 12/1987 Kinnunen
4,729,412 A 3/1988 Bugge
4,731,281 A 3/1988 Fleischer et al.
4,739,803 A 4/1988 Borel
4,755,420 A 7/1988 Baker et al.
4,759,975 A 7/1988 Sutherland et al.
4,813,459 A * 3/1989 Breidegam ..... 139/421
4,815,499 A 3/1989 Johnson
4,815,503 A 3/1989 Borel
4,909,284 A 3/1990 Kositzke
RE33,195 E 4/1990 McDonald et al.
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,987,929 A 1/1991 Wilson
4,989,647 A 2/1991 Marchand
4,989,648 A 2/1991 Tate et al.
4,998,568 A 3/1991 Vohringer
4,998,569 A 3/1991 Tate
5,022,441 A 6/1991 Tate et al.
5,025,839 A 6/1991 Wright
5,067,526 A 11/1991 Herring
5,074,339 A 12/1991 Vohringer
5,084,326 A 1/1992 Vohringer
5,092,372 A 3/1992 Fitzka et al.
5,101,866 A 4/1992 Quigley
5,116,478 A 5/1992 Tate et al.
5,152,326 A 10/1992 Vohringer
5,158,118 A 10/1992 Tate et al.
5,219,004 A 6/1993 Chiu
5,228,482 A 7/1993 Fleischer
5,277,967 A 1/1994 Zehle et al.
5,358,014 A 10/1994 Kovar
5,421,374 A 6/1995 Wright
5,421,375 A 6/1995 Praetzel
5,429,686 A 7/1995 Chiu et al.
5,437,315 A 8/1995 Ward
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,518,042 A 5/1996 Wilson
5,520,225 A 5/1996 Quigley et al.
5,542,455 A 8/1996 Ostermayer et al.
5,555,917 A 9/1996 Quigley
5,564,475 A 10/1996 Wright
5,641,001 A 6/1997 Wilson
5,651,394 A 7/1997 Marchand
5,709,250 A 1/1998 Ward et al.
RE35,777 E 4/1998 Givin
5,746,257 A 5/1998 Fry
5,823,232 A * 10/1998 Georgii ..... 139/383 R
5,826,627 A 10/1998 Seabrook et al.
5,857,498 A 1/1999 Barreto et al.
5,881,764 A * 3/1999 Ward ..... 139/383 A
5,894,867 A 4/1999 Ward et al.
5,899,240 A 5/1999 Wilson
5,937,914 A 8/1999 Wilson
5,967,195 A 10/1999 Ward
5,983,953 A 11/1999 Wilson
6,073,661 A 6/2000 Wilson
6,112,774 A 9/2000 Wilson
6,123,116 A 9/2000 Ward et al.
6,145,550 A 11/2000 Ward
6,148,869 A 11/2000 Quigley
6,158,478 A 12/2000 Lee et al.
6,179,013 B1 * 1/2001 Gulya ..... 139/383 A
6,179,965 B1 1/2001 Cunnane et al.
6,202,705 B1 3/2001 Johnson et al.
6,207,598 B1 3/2001 Lee et al.
6,210,771 B1 * 4/2001 Post et al. ..... 428/100
6,227,255 B1 5/2001 Osterberg et al.
6,237,644 B1 5/2001 Hay et al.
6,240,973 B1 6/2001 Stone et al.
6,244,306 B1 6/2001 Troughton
6,253,796 B1 * 7/2001 Wilson et al. ..... 139/383 A
6,276,402 B1 8/2001 Herring
6,289,939 B1 * 9/2001 Mortensen et al. ..... 139/22
6,305,432 B1 * 10/2001 Sacks et al. ..... 139/425 R
6,341,504 B1 * 1/2002 Istook ..... 66/172 E
6,379,506 B1 4/2002 Wilson et al.
6,581,212 B1 * 6/2003 Andresen ..... 2/167
6,581,645 B1 6/2003 Johnson et al.
6,585,006 B1 7/2003 Wilson et al.
6,745,797 B2 * 6/2004 Troughton ..... 139/383 A
6,837,277 B2 1/2005 Troughton et al.
6,896,009 B2 * 5/2005 Ward ..... 139/383 A
7,001,489 B2 2/2006 Taipale et al.
2003/0010393 A1 1/2003 Kuji
2004/0079434 A1 4/2004 Martin et al.
2004/0102118 A1 5/2004 Hay et al.
2006/0185753 A1 * 8/2006 Ward ..... 139/383 A

FOREIGN PATENT DOCUMENTS

DE 33 29 740 A1 3/1985
EP 0 048 962 B2 9/1981
EP 0 158 710 A1 10/1984
EP 0 185 177 B1 10/1985
EP 0 224 276 12/1986
EP 0 264 881 B1 10/1987
EP 0 269 070 B1 11/1987
EP 0 284 575 B1 2/1988
EP 0 283 181 B1 3/1988
EP 0 350 673 B1 6/1989
EP 0 408 849 A2 5/1990
EP 0 408 849 A3 5/1990
EP 0 672 782 B1 3/1995
EP 0 794 283 A1 9/1997
EP 0 794 283 B1 9/1997
FR 2 597 123 A1 4/1986
GB 2 157 328 A 10/1985
GB 2 245 006 A 2/1991
JP 8-158285 12/1994
WO WO 86/00099 1/1986
WO WO 89/09848 4/1989
WO WO 03/10304 A2 11/1992
WO WO 99/61698 5/1999
WO WO 02/00096 A2 1/2002

WO WO 03/093573 A1 11/2003

OTHER PUBLICATIONS

International Search Report for PCT Application No. PCT/US97/18629.
Rule 132 Declaration of Robert G. Wilson (Jun. 26, 1997).
Warren, C.A., "The Importance of Yarn Properties in Wet-End Wire Construction," Seminar, The Theory of Water Removal, Dec. 12, 1979.
European Search Report corresponding to application No. EP 05002306.8, dated Oct. 18, 2005.

* cited by examiner 131
132
133
134
135
136
137
138
139
140
141
142
143
144
145
146
151a
171
172
173
174
175
176
177
178
111
151b
121a
161
121b

PAPERMAKER'S FORMING FABRIC WITH MACHINE DIRECTION STITCHING YARNS THAT FORM MACHINE SIDE KNUCKLES

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

U.S. Pat. No. 6,896,009 and co-pending and co-assigned U.S. patent application Ser. No. 11/207,277, filed Aug. 18, 2005 describe a number of exemplary multi-layer forming fabrics that are "warped-stitched." In some instances such fabrics may be easier to manufacture than weft-stitched forming fabrics and/or may have desirable performance properties. However, there is still a demand for additional types of warp-stitched fabrics to meet the vast array of papermaking needs.

SUMMARY OF THE INVENTION

As a first aspect, embodiments of the present invention are directed to a papermaking fabric, comprising a series of repeat units, each of the repeat units including: a set of top MD yarns; a set of top CMD yarns interwoven with the set of top MD yarns; a first set of bottom MD yarns, the first set of bottom MD yarns arranged in pairs; a second set of bottom MD yarns, the second set of bottom MD yarns arranged as single yarns; a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set. Each of the yarns of a pair of the first set of bottom MD yarns interweaves with the bottom CMD yarns in the same pattern.

As a second aspect, embodiments of the present invention are directed to a papermaking fabric, comprising a series of repeat units, each of the repeat units including: a set of top MD yarns; a set of top CMD yarns interwoven with the set of top MD yarns; a first set of bottom MD yarns, the first set of bottom MD yarns arranged in pairs; a second set of bottom MD yarns, the second set of bottom MD yarns arranged as single yarns; a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set. Each of the yarns of a pair of the first set of bottom MD yarns interweaves with the bottom CMD yarns in the same pattern. Also, each pair of bottom MD yarns of the first set is positioned beneath a top MD yarn.

As a third aspect, embodiments of the present invention are direction to a papermaking fabric, comprising a series of repeat units, each of the repeat units including: a set of top machine direction (MD) yarns; a set of top cross machine direction (CMD) yarns interwoven with the set of top MD yarns; a first set of bottom MD yarns, each of the yearns of the first set having a flattened cross-section; a second set of bottom MD yarns, the second set of bottom MD yarns arranged as single yarns; a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set.

As a fourth aspect, embodiments of the present invention are directed to a method of making paper, comprising the steps of: (a) providing a papermaking fabric, the fabric comprising: a set of top MD yarns; a set of top CMD yarns interwoven with the set of top MD yarns; a first set of bottom MD yarns, the first set of bottom MD yarns arranged in pairs; a second set of bottom MD yarns, the second set of bottom MD yarns arranged as single yarns; a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set; wherein each of the yarns of a pair of the first set of bottom MD yarns interweaves with the bottom CMD yarns in the same pattern; (b) depositing paper stock on the papermaking fabric; and (c) removing moisture from the papermaking stock.

DETAILED DESCRIPTION OF EMBODIMENTS OF THE INVENTION

Figure 1:
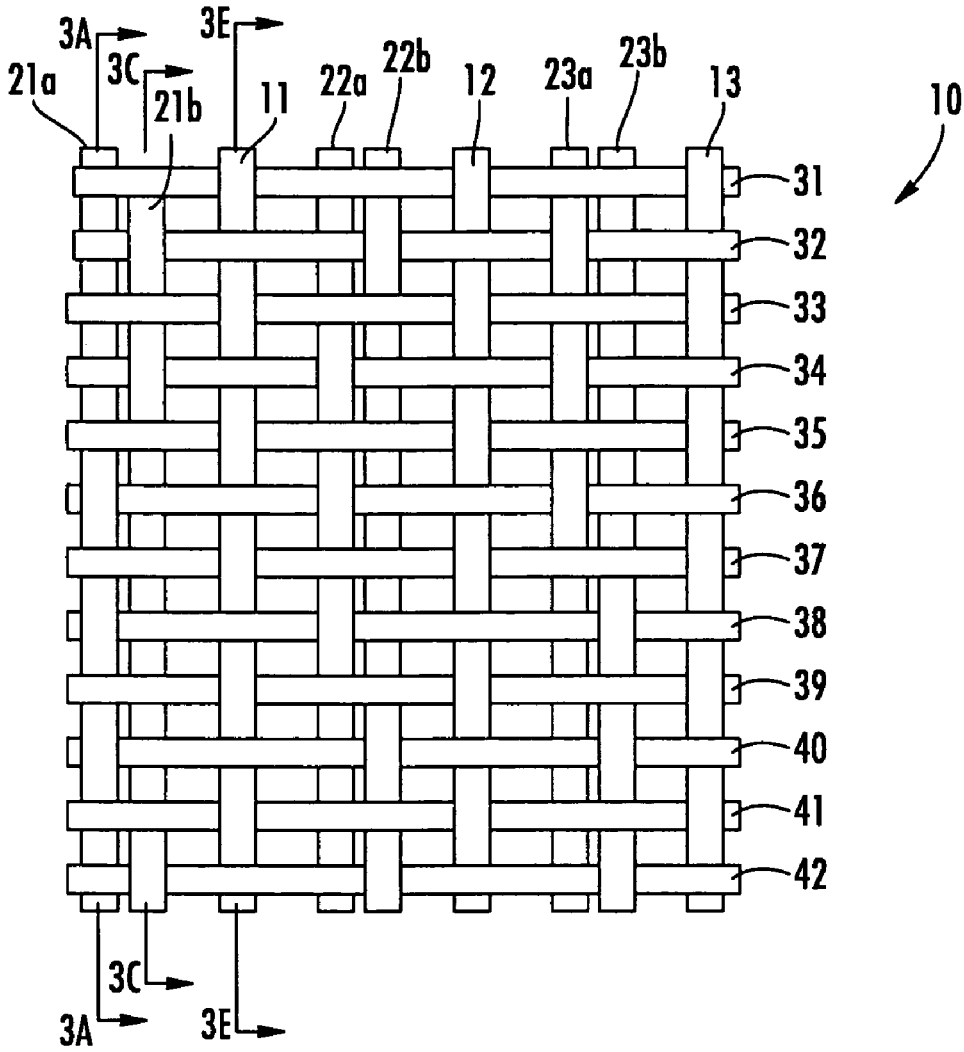
FIG. 1 is a top view of a repeat unit of a forming fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Turning now to FIGS. 1–3F, a repeat unit of a forming fabric according to embodiments of the present invention, designated broadly at 10, is illustrated therein. The repeat unit 10 includes three top MD yarns 11–13, three pairs of MD stitching yarns 21*a*, 21*b*–23*a*, 23*b*, twelve top CMD yarns 31–42, six paired bottom MD yarns 51*a*, 51*b*–53*a*, 53*b*, three unpaired bottom MD yarns 61–63, and six bottom CMD yarns 71–76. The interweaving of these yarns is described below.

Figure 3A:
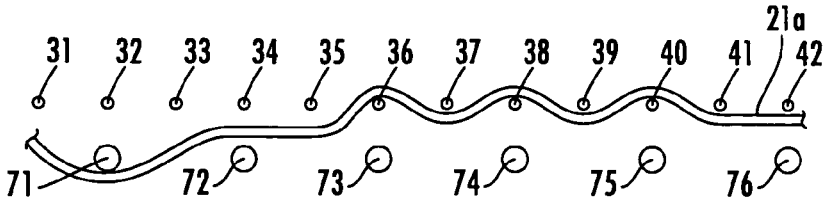
FIGS. 3A–3F are section views taken of exemplary machine direction yarns of the fabric of FIGS. 1 and 2.
Figure 3B:
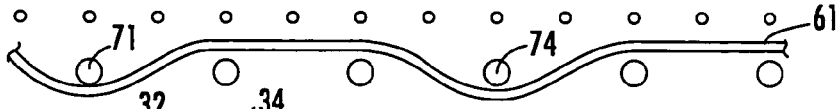
Figure 3C:
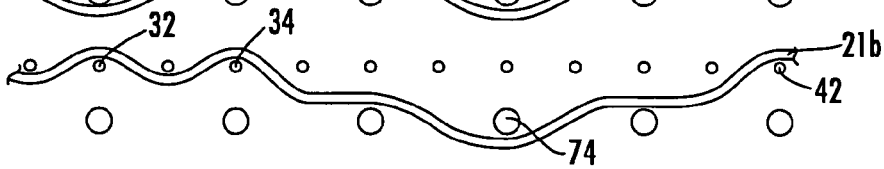
Figure 3D:
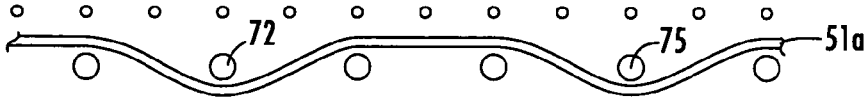
Figure 3E:
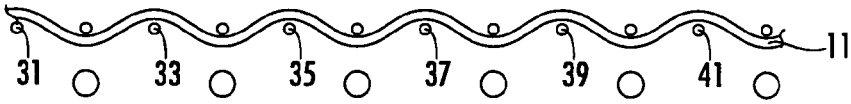
Figure 3F:
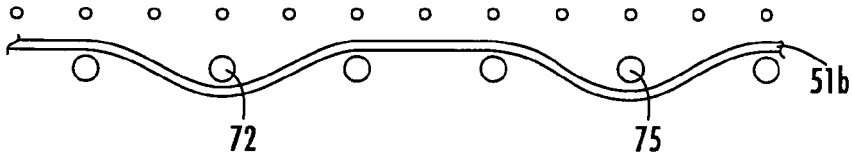

As can be seen in FIGS. 1 and 3E, each of the top MD yarns 11–13 interweaves with the top CMD yarns 31–42 in an "over 1/under 1" sequence, in which the top MD yarns 11–13 pass over the odd-numbered top CMD yarns 31, 33, 35, 37, 39, 41 and under the even-numbered top CMD yarns 32, 34, 36, 38, 40, 42.

As can be seen in FIG. 1, each stitching yarn pair 21*a*, 21*b*–23*a*, 23*b* is located between two top MD yarns. As can be seen in FIGS. 1, 3A and 3C, each of the stitching yarn pairs 21*a*–23*b* combines to act as a single yarn in completing the plain weave pattern on the top surface of the fabric 10. More specifically, each of the stitching yarns passes over three even-numbered top CMD yarns, with the stitching yarns designated with an "a" passing over one set of three even-numbered top CMD yarns, and each of the stitching yarns designated with a "b" passing over a set of the remaining three even-numbered top CMD yarns. For example, stitching yarn 21*a* passes over top CMD yarns 36, 38 and 40 while passing below top CMD yarns 35, 37, 39 and 41, and stitching yarn 21*b* passes over top CMD yarns 42, 32 and 34 while passing below top CMD yarns 41, 31, 33 and 35. Thus, together stitching yarns 21*a*, 21*b* form a "composite" top MD yarn that follows an overall "over 1/under 1" path relative to the top CMD yarns. The "composite" top MD yarn thusly formed passes over even-numbered top CMD yarns, thereby forming a plain weave pattern with the top MD yarns on the top, or papermaking, surface of the fabric 10.

Each pair of stitching yarns is offset from its neighboring stitching yarn pairs by two top CMD yarns. This can be seen by examination of FIG. 1, wherein stitching yarns 21*a*, 21*b* both pass below top CMD yarn 35 as they travel between the top and bottom layers of the fabric 10. Moving up FIG. 1 and to stitching yarns 22*a*, 22*b*, these yarns both pass below top CMD yarn 33 (which is offset from top CMD yarn 35 by two top CMD yarns) as they travel between the top and bottom layers.

Figure 2:
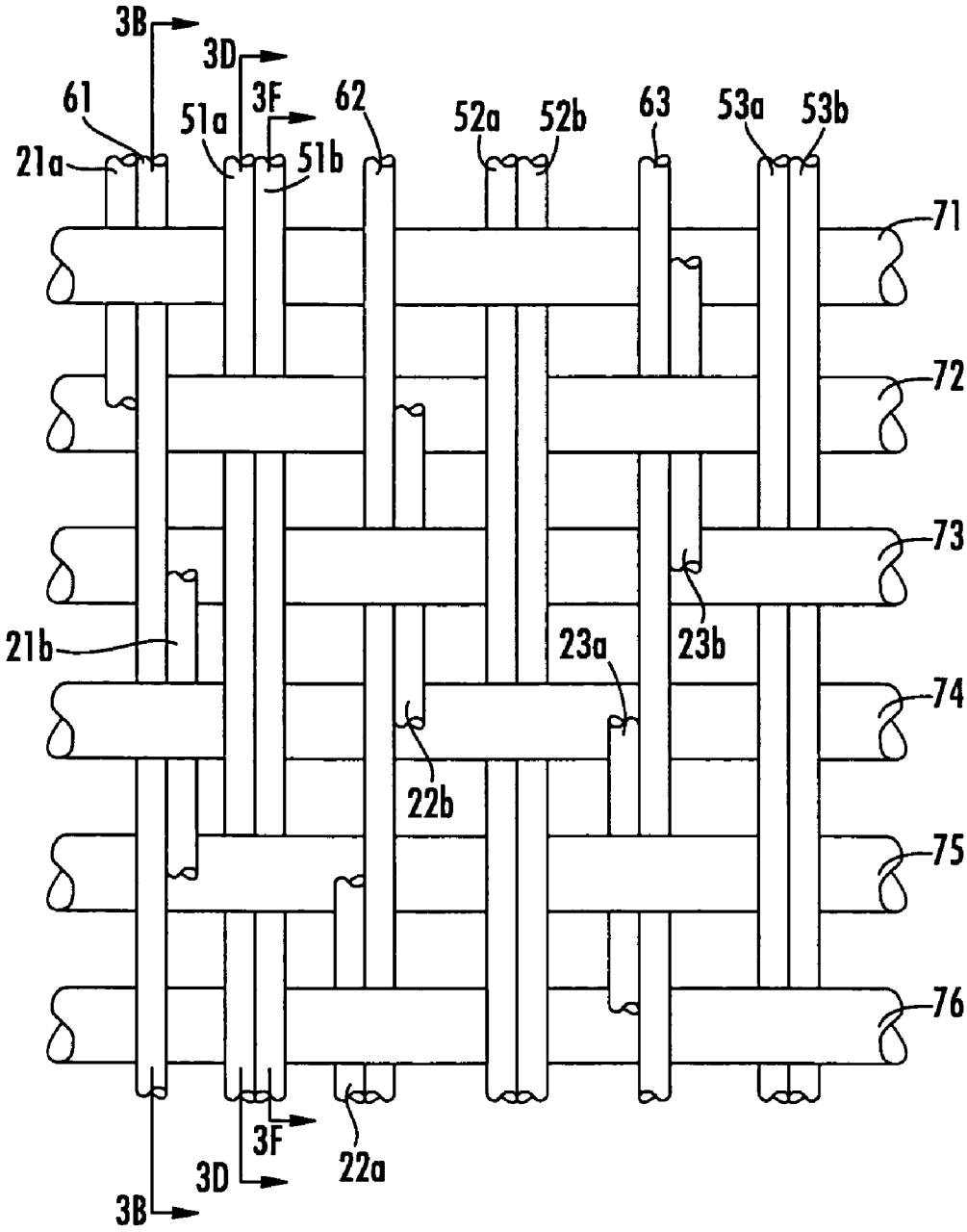
FIG. 2 is a bottom view of the repeat unit of the fabric of FIG. 1.

The bottom layer of the fabric 10 is illustrated in FIG. 2. The bottom layer includes paired bottom MD yarns 51*a*, 51*b*–53*a*, 53*b*, unpaired bottom MD yarns 61–63, stitching yarns 21*a*, 21*b*–23*a*, 23*b* and bottom CMD yarns 71–76. The paired bottom MD yarns, which are located beneath a corresponding top MD yarn, interweave as a pair with the bottom CMD yarns in an "over 2/under 1" sequence. For example, referring to FIGS. 2, 3D and 3F, bottom MD yarns 51*a*, 51*b* pass over bottom CMD yarns 73, 74, under bottom CMD yarn 75, over bottom CMD yarns 76, 71 and under bottom CMD yarn 72. Each unpaired bottom MD yarn also follows an "over 2/under 1" sequence as it interweaves with the bottom CMD yarns. For example, unpaired bottom MD yarn 61 passes over bottom CMD yarns 72, 73, under bottom CMD yarn 74, over bottom CMD yarns 75, 76 and under bottom CMD yarn 71 (see FIGS. 2 and 3B).

The paired bottom MD yarns, which are located beneath a corresponding top MD yarn, interweave as a pair with the bottom CMD yarns in a repeating "over 2/under 1" sequence. For example, referring to FIGS. 2, 3D and 3F, bottom MD yarns 51*a*, 51*b* pass over bottom CMD yarns 73, 74, under bottom CMD yarn 75, over bottom CMD yarns 76, 71 and under bottom CMD yarn 72. Each unpaired bottom MD yarn also follows an "over 2/under 1" sequence as it interweaves with the bottom CMD yarns. For example, unpaired bottom MD yarn 61 passes over bottom CMD yarns 71, 72, under bottom CMD yarn 73, over bottom CMD yarns 74, 75 and under bottom CMD yarn 76 (see FIGS. 2 and 3B).

Referring again to FIG. 2, each pair of stitching yarns sandwiches an unpaired bottom MD yarn (e.g., stitching yarns 21*a*, 21*b* sandwich bottom MD yarn 61), and each stitching yarn forms one knuckle under a bottom CMD yarn. As used herein, "knuckle" refers to a portion of one yarn that, in interweaving with other yarns, passes above or below a single other yarn, whereas a "float" refers to a portion of one yarn that passes above or below multiple adjacent yarns. Each knuckle formed by a stitching yarn is positioned beside a knuckle formed by the immediately adjacent unpaired bottom MD yarn, such that each stitching yarn pair and the unpaired bottom MD yarns form pairs of knuckles similar to the paired knuckles of the paired bottom MD yarns. For example, unpaired bottom MD yarn 61 forms knuckles below bottom CMD yarns 71 and 74 (see FIGS. 3A–3C). Stitching yarn 21*b* forms a knuckle under bottom CMD yarn 71, and stitching yarn 21*a* forms a knuckle under bottom CMD yarn 74. Each pair of paired bottom MD yarns is offset from its neighboring unpaired bottom MD yarn by one bottom CMD yarn. For example, unpaired bottom MD yarn 61 forms a knuckle under bottom CMD yarn 71, and paired bottom yarns 51*a*, 51*b* form knuckles under bottom CMD yarn 72. As a result, the pairs of knuckles on the bottom surface form a diagonal thereon.

A repeat unit of another fabric according to embodiments of the present invention is designated broadly at 110 and is illustrated in FIGS. 4–6F. The repeat unit 110 includes four top MD yarns 111–114, four pairs of MD stitching yarns 121*a*, 121*b*–124*a*, 124*b*, sixteen top CMD yarns 131–146, eight paired bottom MD yarns 151*a*, 151*b*–154*a*, 154*b*, four unpaired bottom MD yarns 161–164, and eight bottom CMD yarns 171–178. The interweaving of these yarns is described below.

Figure 4:
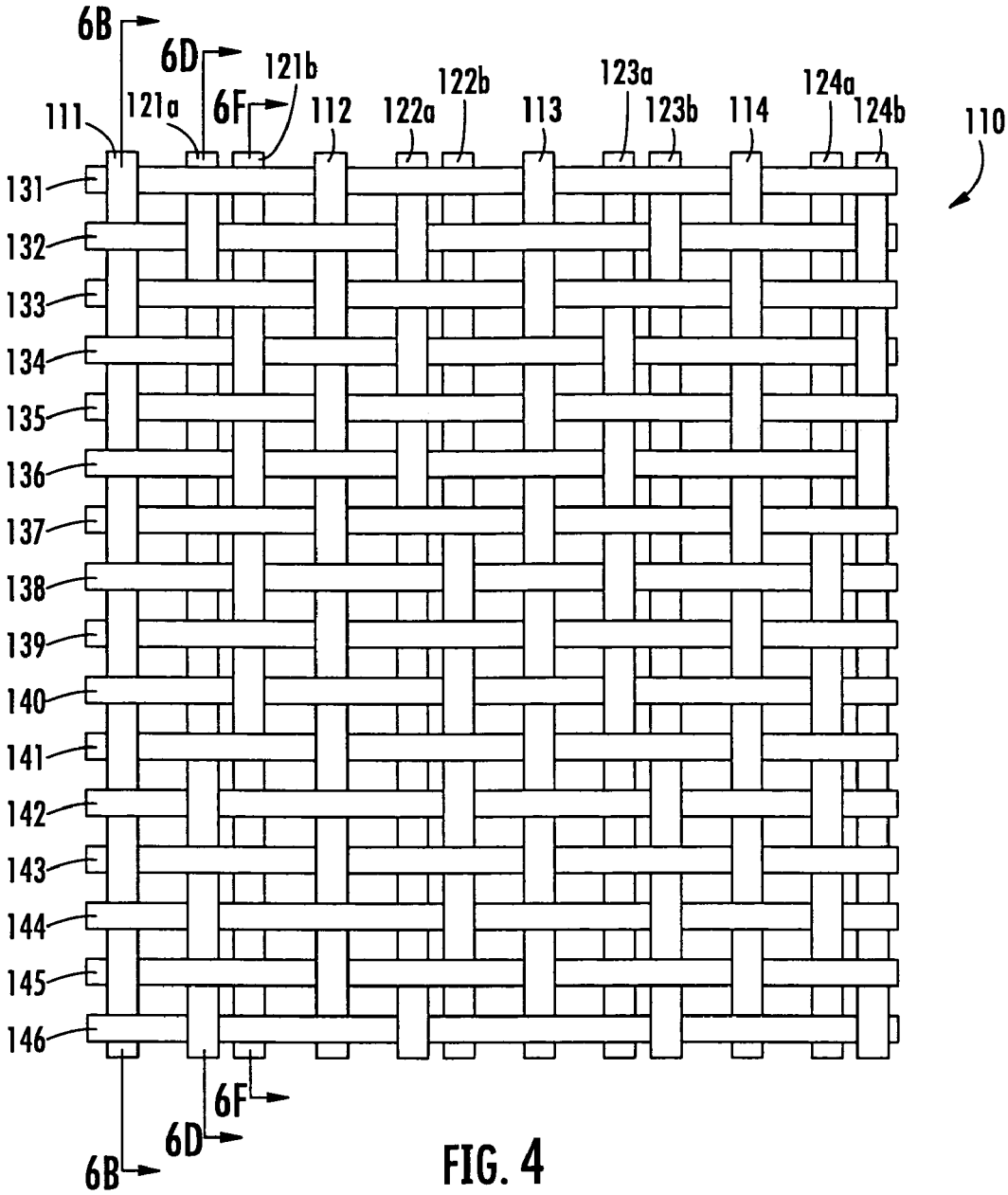
FIG. 4 is a top view of a repeat unit of a forming fabric according to other embodiments of the present invention.
Figures 6A, 6B, 6C, 6D, 6E, 6F:
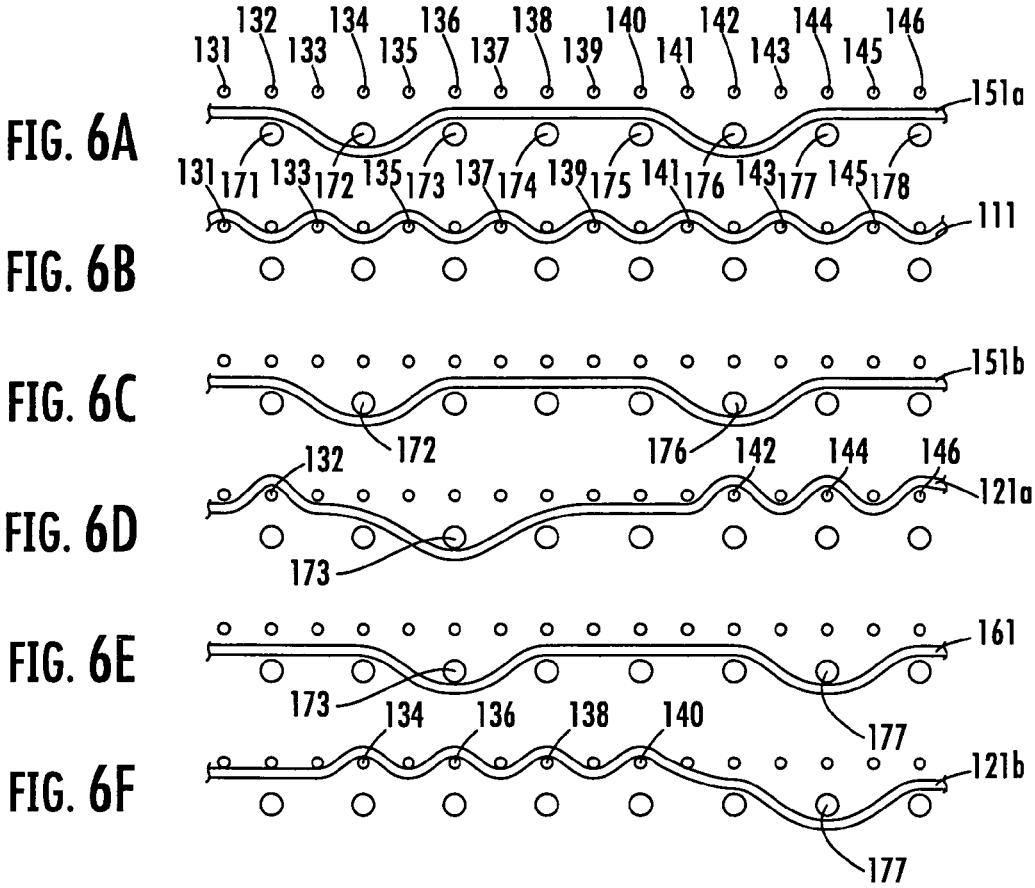
FIGS. 6A–6F are section views taken of exemplary machine direction yarns of the fabric of FIGS. 4 and 5.

As can be seen in FIGS. 4 and 6B, each of the top MD yarns 111–114 interweaves with the top CMD yarns 131–146 in an "over 1/under 1" sequence, in which the top MD yarns 111–114 pass over the odd-numbered top CMD yarns 131, 133, 135, 137, 139, 141, 143, 145 and under the even-numbered top CMD yarns 132, 134, 136, 138, 140, 142, 144, 146.

As can be seen in FIG. 4, each stitching yarn pair 121*a*, 121*b*–124*a*, 124*b* is located between two top MD yarns. Like the stitching yarns of the fabric 10 described above, and as can be seen in FIGS. 4, 6D and 6F, each of the stitching yarn pairs 121*a*–124*b* combines to act as a single yarn in completing the plain weave pattern on the top surface of the fabric 110. More specifically, each of the stitching yarns passes over four even-numbered top CMD yarns, with the stitching yarns designated with an "a" passing over one set of four even-numbered top CMD yarns, and each of the stitching yarns designated with a "b" passing over a set of the remaining four even-numbered top CMD yarns. For example, stitching yarn 121*a* passes over top CMD yarns 142, 144, 146, and 132 while passing below top CMD yarns 141, 143, 145, 131 and 133, and stitching yarn 121*b* passes over top CMD yarns 134, 136, 138 and 140 while passing below top CMD yarns 133, 135, 137, 139 and 141. Together the stitching yarns 121*a*, 121*b* form a composite top MD yarn that follows an overall "over 1/under 1" path while interweaving with the top CMD yarns. The composite top MD yarns formed by the stitching yarns pass over even-numbered top CMD yarns, thereby forming a plain weave pattern with the top MD yarns on the top, or papermaking, surface of the fabric 110.

Each pair of stitching yarns is offset from its neighboring stitching yarn pairs by four top CMD yarns. This can be seen by examination of FIG. 4, wherein stitching yarns 121*a*, 121*b* both pass below top CMD yarn 133 as they travel between the top and bottom layers of the fabric 110. Moving down FIG. 4 and to stitching yarns 122*a*, 122*b*, these yarns both pass below top CMD yarn 137 (which is offset from top CMD yarn 133 by four top CMD yarns) as they travel between the top and bottom layers.

Figure 5:
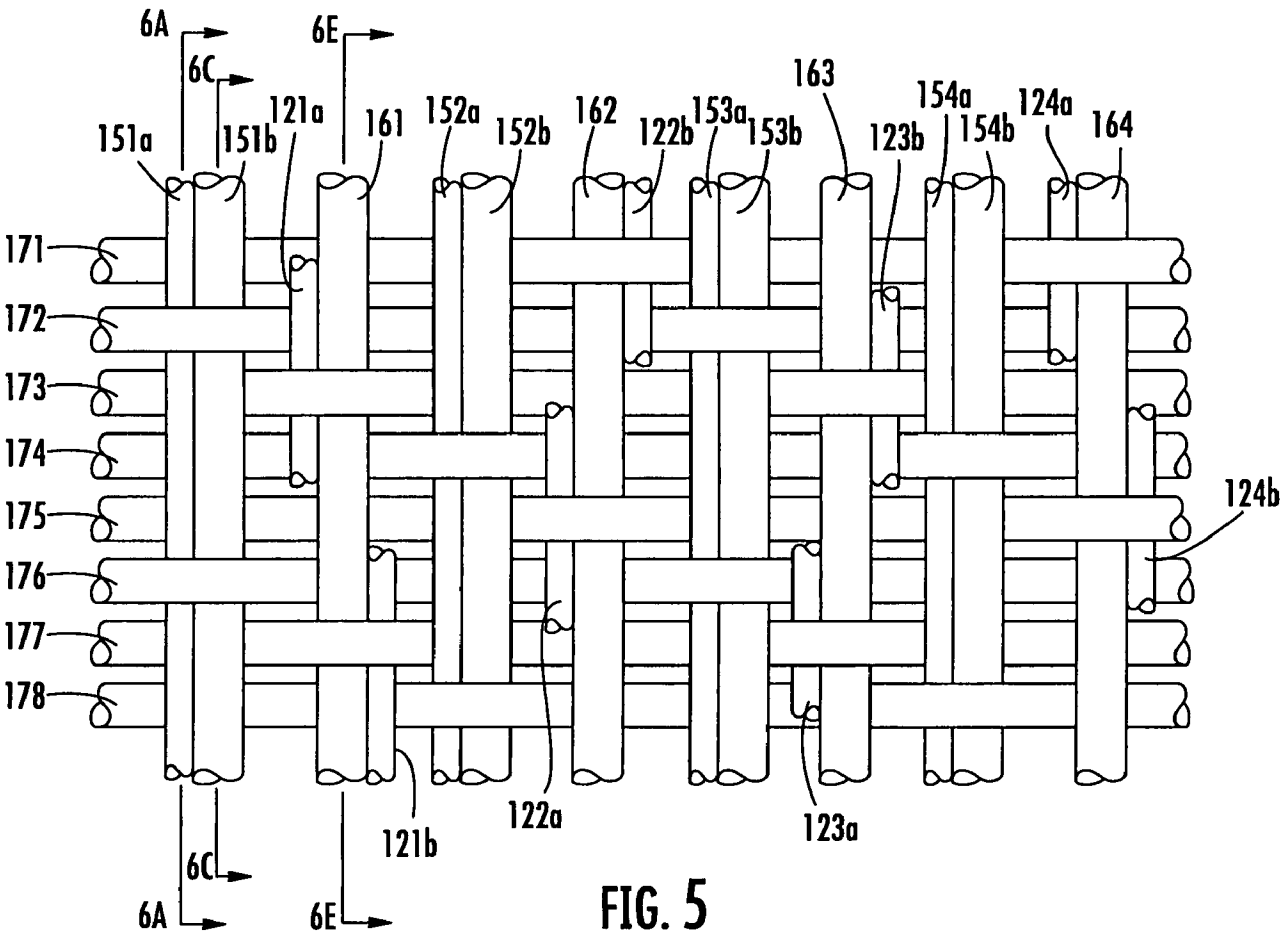
FIG. 5 is a bottom view of the repeat unit of the fabric of FIG. 4.

The bottom layer of the fabric 110 is illustrated in FIG. 5. The bottom layer includes paired bottom MD yarns 151*a*, 151*b*–154*a*, 154*b*, unpaired bottom MD yarns 161–164, stitching yarn pairs 121*a*, 121*b*–124*a*, 124*b* and bottom CMD yarns 171–178. The paired bottom MD yarns, which are located beneath a corresponding top MD yarn, interweave as a pair with the bottom CMD yarns in an "over 3/under 1" sequence. For example, referring to FIGS. 5, 6A and 6C, bottom MD yarns 151*a*, 151*b* pass over bottom CMD yarns 173, 174, 175, under bottom CMD yarn 176, over bottom CMD yarns 177, 178, 171 and under bottom CMD yarn 172. Each unpaired bottom MD yarn also follows an "over 3/under 1" sequence as it interweaves with the bottom CMD yarns. For example, unpaired bottom MD yarn 161 passes over bottom CMD yarns 178, 171, 172, under bottom CMD yarn 173, over bottom CMD yarns 174, 175, 176 and under bottom CMD yarn 177 (see FIGS. 5 and 6E).

Referring again to FIG. 5, each pair of stitching yarns sandwiches an unpaired bottom MD yarn (e.g. stitching yarns 121*a*, 121*b* sandwich bottom MD yarn 161). Each stitching yarn forms one knuckle under a bottom CMD yarn beside a knuckle formed by the immediately adjacent unpaired bottom MD yarn, such that each stitching yarn pair and the unpaired bottom MD yarns form pairs of knuckles similar to the paired knuckles of the paired bottom MD yarns. For example, unpaired bottom MD yarn 161 forms knuckles below bottom CMD yarns 173 and 177 (see FIG. 6E). Stitching yarn 121*a* forms a knuckle under bottom CMD yarn 173, and stitching yarn 121*b* forms a knuckle under bottom CMD yarn 177 (see FIGS. 6D and 6F). Each pair of paired bottom MD yarns is offset from its neighboring unpaired bottom MD yarn by one bottom CMD yarn. For example, unpaired bottom MD yarn 161 forms a knuckle under bottom CMD yarn 173, and paired bottom yarns 151*a*, 151*b* form knuckles under bottom CMD yarn 172. As a result, the pairs of knuckles on the bottom surface form a diagonal thereon.

It can be seen that, in the illustrated embodiment, the paired "a" bottom MD yarns are smaller in diameter than the paired "b" bottom MD yarns. It may be desirable in some embodiments for the "a" yarns to match the diameter of the stitching yarns, such that the paired knuckles of (a) the paired bottom MD yarns and (b) the pair knuckles of the unpaired bottom MD yarns and the stitching yarns are the same dimension. Those skilled in this art will appreciate that, in other embodiments (such as those of FIGS. 1–3F and FIGS. 7–9F), the paired "a" and "b" bottom MD yarns may be of the same diameter.

A repeat unit of a further fabric according to embodiments of the present invention is designated broadly at 210 and is illustrated in FIGS. 7–9F. The repeat unit 210 includes five top MD yarns 211–215, five pairs of MD stitching yarns 221*a*, 221*b*–225*a*, 225*b*, twenty top CMD yarns 231–250, ten paired bottom MD yarns 251*a*, 251*b*–255*a*, 255*b*, five unpaired bottom MD yarns 261–265, and ten bottom CMD yarns 271–280. The interweaving of these yarns is described below.

Figure 7:
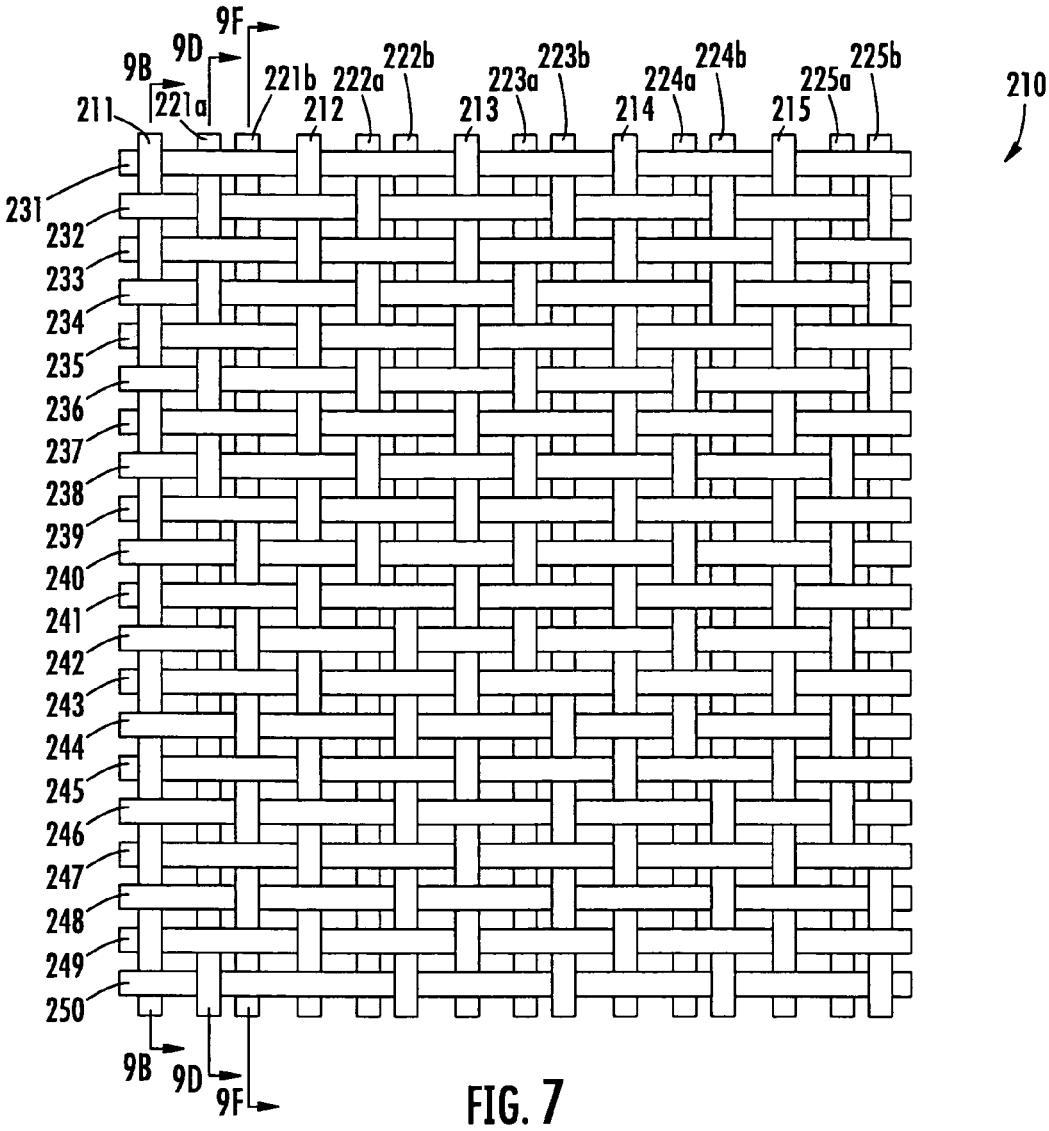
FIG. 7 is a top view of a repeat unit of a forming fabric according to additional embodiments of the present invention.
Figures 9A, 9B, 9C, 9D, 9E, 9F:
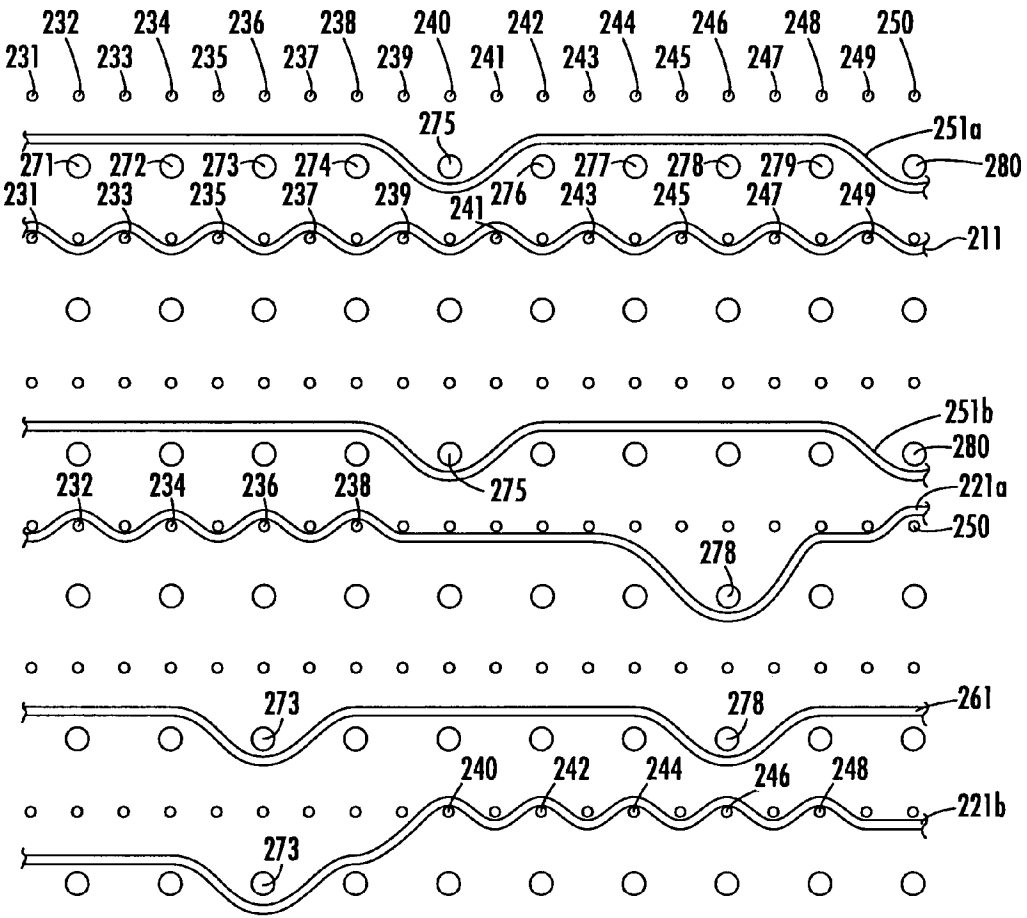
FIGS. 9A–9F are section views taken of exemplary machine direction yarns of the fabric of FIGS. 7 and 8.

As can be seen in FIGS. 7 and 9B, each of the top MD yarns 211–215 interweaves with the top CMD yarns 231–250 in an "over 1/under 1" sequence, in which the top MD yarns 211–215 pass over the odd-numbered top CMD yarns 231, 233, 235, 237, 239, 241, 243, 245, 247, 249 and under the even-numbered top CMD yarns 232, 234, 236, 238, 240, 242, 244, 246, 248, 250.

As can be seen in FIG. 7, each stitching yarn pair 221*a*, 221*b*–225*a*, 225*b* is located between two top MD yarns. Like the stitching yarns of the fabrics 10 and 110 described above, and as can be seen in FIGS. 7, 9D and 9F, each of the stitching yarn pairs 221*a*–225*b* combines to act as a single yarn in completing the plain weave pattern on the top surface of the fabric 210. More specifically, each of the stitching yarns passes over five even-numbered top CMD yarns, with the stitching yarns designated with an "a" passing over one set of five even-numbered top CMD yarns, and each of the stitching yarns designated with a "b" passing over a set of the remaining five even-numbered top CMD yarns. For example, stitching yarn 221*a* passes over top CMD yarns 250, 232, 234, 236, and 238 while passing below top CMD yarns 249, 231, 233, 235, 237 and 239, and stitching yarn 221*b* passes over top CMD yarns 240, 242, 244, 246 and 248 while passing below top CMD yarns 239, 241, 243, 245, 247 and 249. Together the stitching yarns 221*a*, 221*b* form a composite top MD yarn that follows an overall "over 1/under 1" path while interweaving with the top CMD yarns. The composite top MD yarns formed by the stitching yarns pass over even-numbered top CMD yarns, thereby forming a plain weave pattern with the top MD yarns on the top, or papermaking, surface of the fabric 210.

Each pair of stitching yarns is offset from its neighboring stitching yarn pairs by two top CMD yarns. This can be seen by examination of FIG. 7, wherein stitching yarns 221*a*, 221*b* both pass below top CMD yarn 239 as they travel between the top and bottom layers of the fabric 210. Moving down FIG. 7 and to stitching yarns 222*a*, 222*b*, these yarns both pass below top CMD yarn 241 (which is offset from top CMD yarn 239 by two top CMD yarns) as they travel between the top and bottom layers.

Figure 8:
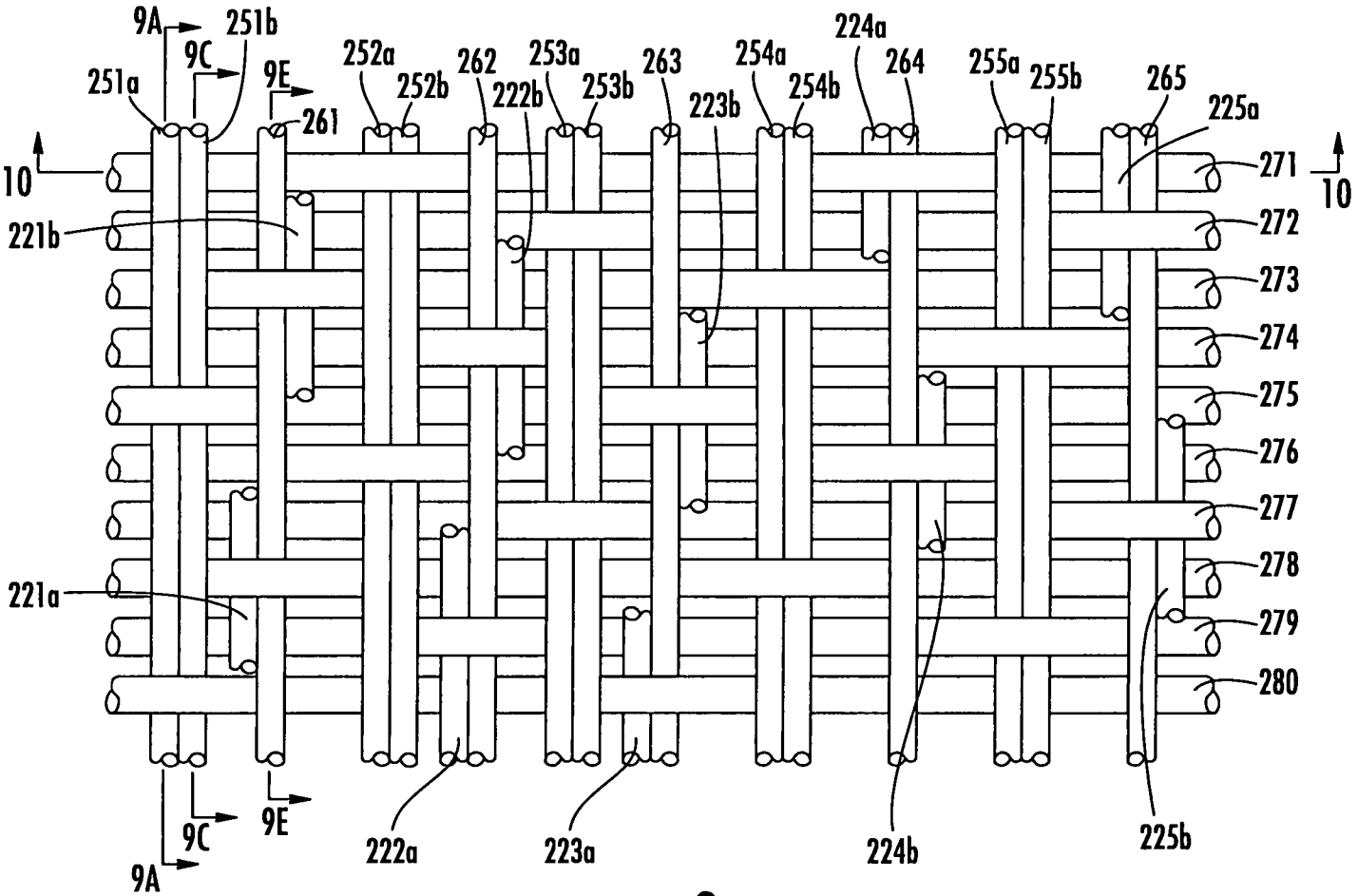
FIG. 8 is a bottom view of the repeat unit of the fabric of FIG. 7.

The bottom layer of the fabric 210 is illustrated in FIG. 8. The bottom layer includes paired bottom MD yarns 251*a*, 251*b*–255*a*, 255*b*, unpaired bottom MD yarns 261–265, stitching yarn pairs 221*a*, 221*b*–225*a*, 225*b* and bottom CMD yarns 271–280. The paired bottom MD yarns, which are located beneath a corresponding top MD yarn, interweave as a pair with the bottom CMD yarns in an "over 4/under 1" sequence. For example, referring to FIGS. 7, 9A and 9C, paired bottom MD yarns 251*a*, 251*b* pass over bottom CMD yarns 271–274, under bottom CMD yarn 275, over bottom CMD yarns 276–279 and under bottom CMD yarn 280. Each unpaired bottom MD yarn also follows an "over 4/under 1" sequence as it interweaves with the bottom CMD yarns. For example, unpaired bottom MD yarn 261 passes over bottom CMD yarns 271, 272, under bottom CMD yarn 273, over bottom CMD yarns 274–277, under bottom CMD yarn 278, and over bottom CMD yarns 279, 280 (see FIGS. 8 and 9E).

Referring again to FIG. 8, each pair of stitching yarns sandwiches an unpaired bottom MD yarn (e.g. stitching yarns 221*a*, 221*b* sandwich bottom MD yarn 261). Each stitching yarn forms one knuckle under a bottom CMD yarn beside a knuckle formed by the immediately adjacent unpaired bottom MD yarn, such that each stitching yarn pair and the unpaired bottom MD yarns form pairs of knuckles similar to the paired knuckles of the paired bottom MD yarns. For example, unpaired bottom MD yarn 261 forms knuckles below bottom CMD yarns 273 and 278 (see FIG. 9E). Stitching yarn 221*b* forms a knuckle under bottom CMD yarn 273, and stitching yarn 221*a* forms a knuckle under bottom CMD yarn 278 (see FIGS. 9D and 9F).

Each pair of paired bottom MD yarns is offset from its neighboring paired bottom MD yarns by one bottom CMD yarn. For example, paired bottom MD yarns 251*a*, 251*b* pass under bottom CMD yarn 275, and paired bottom MD yarns 252*a*, 252*b* pass under bottom CMD yarn 276, which is offset from bottom CMD yarn 276 by one bottom CMD yarn. Each unpaired bottom MD yarn is also offset from its neighboring unpaired bottom MD yarn by one bottom CMD yarn. For example, unpaired bottom MD yarn 261 forms a knuckle under bottom CMD yarn 273, and unpaired bottom CMD yarn 262 forms a knuckle under bottom CMD yarn 274, which is offset from bottom CMD yarn 273 by one bottom CMD yarn. As a result, the pairs of knuckles formed by the paired bottom MD yarns on the bottom surface form one diagonal thereon, and the pairs of knuckles formed by an unpaired bottom MD yarn and a stitching yarn form a second diagonal on the bottom surface. The knuckles formed by the paired bottom MD yarns are offset from the knuckles formed by an unpaired bottom MD yarn and a stitching yarn are offset from each other by two bottom CMD yarns.

Figure 10:
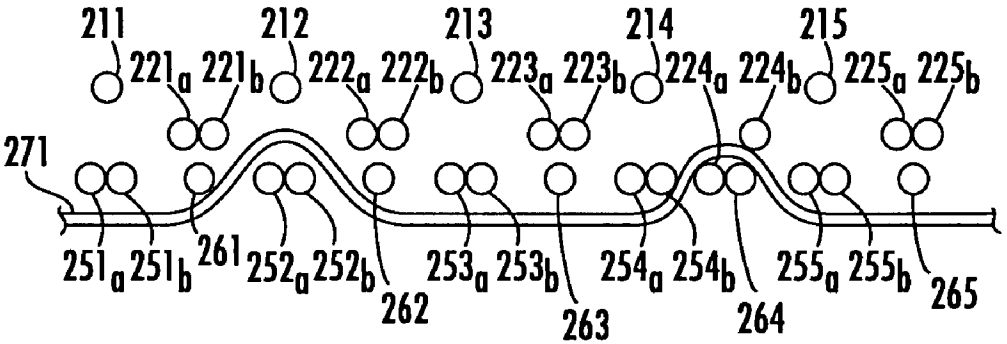
FIG. 10 is a section view taken of an exemplary top CMD yarn of the fabric of FIGS. 7 and 8.
Figure 11:
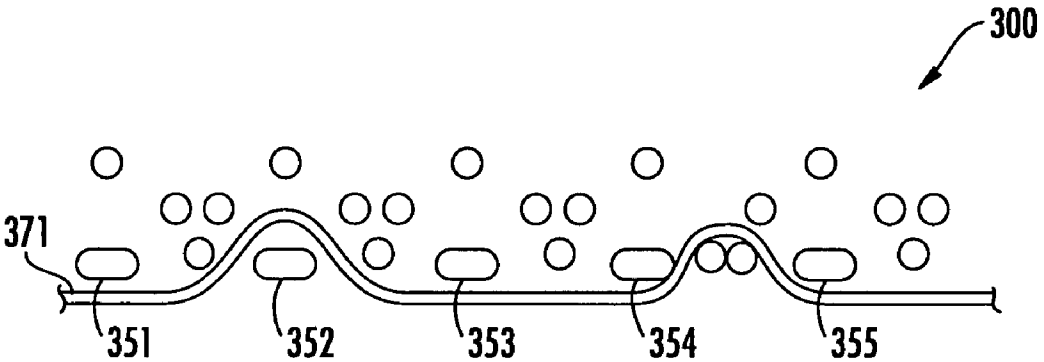
FIG. 11 is a section taken of an exemplary top CMD yarn of an alternative fabric embodiment that employs bottom MD yarns that are flattened in cross-section.

As can be seen in FIG. 10, the paired bottom MD yarns 251*a*, 251*b*–255*a*, 255*b* weave together with the bottom CMD yarns 271–280. As such, in some embodiments the paired bottom MD yarns may be replaced by a single bottom MD yarn of flattened cross-section. This substitution is illustrated in FIG. 11, in which the paired bottom MD yarns 251*a*, 251*b*–255*a*–255*b* of the fabric 200 are replaced with bottom MD yarns 351–355 in a fabric 300. The weave pattern of the fabric 300 can be the same as that of the fabric 200, with the exception that the flattened bottom MD yarns 351–355 follow the paths of the pairs of bottom MD yarns 251*a*, 251*b*–255*a*, 255*b* (see exemplary bottom CMD yarn 371 also). A similar substitution of flattened yarns for the paired bottom MD yarns can be made in the other fabric embodiments described herein. Typically, the flattened yarn will have a height similar to that of the bottom MD yarn for which it is substituted and a width similar to that of two bottom MD yarns for which it is substituted.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyarnide (nylon), polypropylene, aramid, or the like. The skilled artisan should select a yarn material according to the particular application of the final fabric. In particular, round monofilament yarns formed of polyester or polyarnide are preferred.

Fabrics such as those illustrated above can demonstrate improved seam strength compared to similar prior fabrics, which may permit the use of fewer ends for joining the fabric. Also, increases in fabric open area and/or permeability can be achieved.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A papermaking fabric, comprising a series of repeat units, each of the repeat units including:

a set of top machine direction (MD) yarns;

a set of top cross machine direction (CMD) yarns interwoven with the set of top MD yarns;

a first set of bottom MD yarns, the first set of bottom MD yarns arranged in pairs;

a second set of bottom MD yarns, the second set of bottom MD yarns arranged as single yarns;

a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set;

wherein each of the yarns of a pair of the first set of bottom MD yarns interweaves with the bottom CMD yarns in the same pattern.

2. The papermaking fabric defined in claim 1, wherein the yarns of the first set of bottom MD yarns form knuckles below individual bottom CMD yarns.

3. The papermaking fabric defined in claim 2, wherein the yarns of the first set of bottom MD yarns pass over between 2 and 4 bottom CMD yarns between the knuckles formed under bottom CMD yarns.

4. The papermaking fabric defined in claim 1, wherein the yarns of the second set of bottom MD yarns form knuckles below individual bottom CMD yarns.

5. The papermaking fabric defined in claim 4, wherein the yarns of the first set of bottom MD yarns form knuckles below the individual bottom CMD yarns.

6. The papermaking fabric defined in claim 4, wherein the yarns of the second set pass over between 2 and 4 bottom CMD yarns between the knuckles formed under bottom CMD yarns.

7. The papermaking fabric defined in claim 4, wherein each stitching yarn forms a knuckle under a bottom CMD yarn.

8. The papermaking fabric defined in claim 7, wherein each stitching yarn knuckle is formed under the bottom CMD yarn under which the immediately adjacent bottom CMD yarn of the second set forms a knuckle.

9. The papermaking fabric defined in claim 1, wherein the top MD yarns, the stitching yarns, and the top CMD yarns interweave to form a plain weave papermaking surface.

10. A papermaking fabric, comprising a series of repeat units, each of the repeat units including:

a set of top machine direction (MD) yarns;

a set of top cross machine direction (CMD) yarns interwoven with the set of top MD yarns;

a first set of bottom MD yarns, the first set of bottom MD yarns arranged in pairs;

a second set of bottom MD yarns, the second set of bottom MD yarns arranged as single yarns;

a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set;

wherein each of the yarns of a pair of the first set of bottom MD yarns interweaves with the bottom CMD yarns in the same pattern; and wherein each pair of bottom MD yarns of the first set is positioned beneath a top MD yarn.

11. The papermaking fabric defined in claim 10, wherein the yarns of the first set of bottom MD yarns form knuckles below individual bottom CMD yarns.

12. The papermaking fabric defined in claim 11, wherein the yarns of the first set of bottom MD yarns pass over between 2 and 4 bottom CMD yarns between the knuckles formed under bottom CMD yarns.

13. The papermaking fabric defined in claim 10, wherein the yarns of the second set of bottom MD yarns forms knuckles below individual bottom CMD yarns.

14. The papermaking fabric defined in claim 13, wherein the yarns of the first set of bottom MD yarns form knuckles below the individual bottom CMD yarns.

15. The papermaking fabric defined in claim 13, wherein the yarns of the second set pass over between 2 and 4 bottom CMD yarns between the knuckles formed under bottom CMD yarns.

16. The papermaking fabric defined in claim 13, wherein each stitching yarn forms a knuckle under a bottom CMD yarn.

17. The papermaking fabric defined in claim 16, wherein each stitching yarn knuckle is formed under the bottom CMD yarn under which the immediately adjacent bottom CMD yarn of the second set forms a knuckle.

18. The papermaking fabric defined in claim 10, wherein the top MD yarns, the stitching yarns, and the top CMD yarns interweave to form a plain weave papermaking surface.

19. A papermaking fabric, comprising a series of repeat units, each of the repeat units including:

a set of top machine direction (MD) yarns;

a set of top cross machine direction (CMD) yarns interwoven with the set of top MD yarns;

a first set of bottom MD yarns, each of the yeams of the first set having a flattened cross-section;

a second set of bottom MD yarns, the second set of bottom MD yarns arranged as single yarns;

a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set.

20. A method of making paper, comprising the steps of:

(a) providing a papermaking fabric, the fabric comprising:

a set of top machine direction (MD) yarns;

a set of top cross machine direction (CMD) yarns interwoven with the set of top MD yarns;

a first set of bottom MD yarns, the first set of bottom MD yarns arranged in pairs;

a second set of bottom MD yarns, the second set of bottom MD yarns arranged as single yarns;

a set of bottom CMD yarns interwoven with the first and second sets of bottom MD yarns; and a set of pairs of MD stitching yarns interwoven with the top and bottom CMD yarns, each pair of MD stitching yarns sandwiching a respective immediately adjacent bottom MD yarn of the second set;

wherein each of the yarns of a pair of the first set of bottom MD yarns interweaves with the bottom CMD yarns in the same pattern;

(b) depositing paper stock on the papermaking fabric; and (c) removing moisture from the papermaking stock.

21. The method defined in claim 20, wherein each pair of bottom MD yarns of the first set is positioned beneath a top MD yarn.

* * * * *

UNITED STATES PATENT AND TRADEMARK OFFICE

CERTIFICATE OF CORRECTION

PATENT NO. : 7,219,701 B2
APPLICATION NO. : 11/235760
DATED : May 22, 2007
INVENTOR(S) : Ward It is certified that error appears in the above-identified patent and that said Letters Patent is hereby corrected as shown below:

Column 12, Claim 19, Line 7: Please correct "yeams"
To read -- yarns--

Signed and Sealed this

Seventh Day of August, 2007

JON W. DUDAS
*Director of the United States Patent and Trademark Office*